US005472780A

United States Patent [19]

Baris et al.

[11] Patent Number: 5,472,780

[45] Date of Patent: Dec. 5, 1995

[54] SOIL-REPELLENT MONOFILAMENT FOR PAPER MACHINE WIRE-CLOTHS, PRODUCTION THEREOF AND USE THEREOF

[75] Inventors: Halim Baris, Luzern; Erwin Lerch, Emmenbrücke, both of Switzerland

[73] Assignee: Rhone-Poulenc Viscosuisse SA, Emmenbrücke, Switzerland

[21] Appl. No.: 240,664

[22] PCT Filed: Aug. 17, 1990

[86] PCT No.: PCT/CH93/00206

§ 371 Date: Apr. 29, 1994

§ 102(e) Date: Apr. 29, 1994

[87] PCT Pub. No.: WO94/05835

PCT Pub. Date: Mar. 17, 1994

[30] Foreign Application Priority Data

Sep. 1, 1992 [CH] Switzerland ..... 2734/92

[51] Int. Cl.[6] ..... D02G 3/00

[52] U.S. Cl. ..... 428/304; 428/373; 525/177; 162/197; 264/176.1; 264/211.14; 264/211.15; 264/210.8; 264/130

[58] Field of Search ..... 428/364, 373; 525/177; 162/199; 264/176.1, 211.14, 211.15, 210.8, 130, 235.6

[56] References Cited

U.S. PATENT DOCUMENTS

| | | | |
|---|---|---|---|
| 3,562,200 | 2/1971 | Jones | 525/177 |
| 3,723,373 | 3/1973 | Lucas | 525/165 |
| 4,002,581 | 1/1977 | Doke | 525/177 |
| 4,822,454 | 4/1989 | Meirowitz et al. | 162/199 |
| 5,283,110 | 1/1994 | Gardner et al. | 525/165 |

FOREIGN PATENT DOCUMENTS

| | | |
|---|---|---|
| 0506983 | 10/1992 | European Pat. Off. . |
| 3301270 | 7/1984 | Germany . |
| 62-238822 | 10/1987 | Japan . |

*Primary Examiner*—N. Edwards
*Attorney, Agent, or Firm*—Michael J. Striker

[57] ABSTRACT

The soil-repellent monofilament for paper machine wire-cloths consists of at least 85% by weight of polyethylene terephthalate having a viscosity index (V.I.) of at least 96 dl/g and an added copolymer prepared from alkenes and perfluoroalkenes having a melting point from 255° to 275° C. To make the soil-repellent monofilament 1.5 to 5% by weight of tetrafluoroethylene is included by addition to the polymer melt of polyethylene terephthalate prior to extrusion. The soil-repellent monofilament produced by this method has a soiling index of <2 after 5 soiling and cleaning cycles.

3 Claims, 1 Drawing Sheet

SOIL-REPELLENT MONOFILAMENT FOR PAPER MACHINE WIRE-CLOTHS, PRODUCTION THEREOF AND USE THEREOF

BACKGROUND OF THE INVENTION

The invention relates to a soil-repellent monofilament for paper machine wire-cloths, having a diameter from 0.2 to 0.7 mm, of at least 85% by weight of polyethylene terephthalate having a viscosity index (V.I.) of at least 96 dl/g and a copolymer, processes for production, and its use.

By "soil-repellent" properties for paper machine wire-cloths are meant the wet soiling, which also predicates hydrolysis resistance. The soil repellency is intended to lengthen the cleaning cycles of a wire-cloth, the cleaning work being done under a high-pressure water jet and if necessary under friction with a brush. Soil-repellent monofilaments which should also be hydrolysis-resistant at the same time are woven into industrial cloths and used in particular in the dryer part of a paper machine. Such drying wire-cloths are exposed to temperatures far above 100° C. and moisture and, during cleaning, also to increased mechanical stress. Soil-repellent polyester monofils have failed because of their ease of hydrolysis. The addition of additives in the form of stabilizers brought about a further improvement in the hydrolysis resistance, but it is still not sufficient for paper machine wire-cloths of the dryer part. Apart from adding additives, other attempts to enhance the soil-repellent properties include using suitable spin finishes, finishing treatments on the filament, and aftertreatment on the cloth.

Similarly, monofilaments were produced from the copolymer ethylenetetrafluoroethylene, whose thermal and chemical resistance are excellent and are therefore used in chemical process technology. Paper machine dryer wire-cloths are known which carry such monofilaments at the cloth surface and which protect the polyester monofilament base fabric underneath from soiling. However, the excellent chemical properties of the fluoropolymers are coupled with their inadequate tensile strength and elongation properties. Moreover, the production and disposal of a fluoropolymer having a fluorine content of about 50% is very costly compared with a polyester. Attempts have already been made to combine the mechanical properties of a mechanically stable a filament with the desirable chemical properties of a fluoropolymer by sheathing the mechanically stable filament by coextrusion with a fluorine-containing polymer (De-A-3301270). The sheath was kept as thin as possible for economic reasons. However, the known core-sheath threads are not suitable for use as paper machine wire-cloths with repeated use and cleaning under the rough conditions in the operation of a paper mill.

SUMMARY OF THE INVENTION

The object of the invention is to provide a soil-repellent monofilament which meets the high requirements of an industrial cloth in respect of its chemical, soil-repellent, mechanical and abrasion-resistant properties and finds use in particular in the dryer part of a paper machine wire-cloth.

It is a further object of the invention to provide a process which permits the economical production of soil-repellent monofilaments.

The object is achieved according to the invention when the monofilament contains from 1.5 to 5% by weight of a polynary copolymer prepared from alkenes and perfluoroalkenes.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
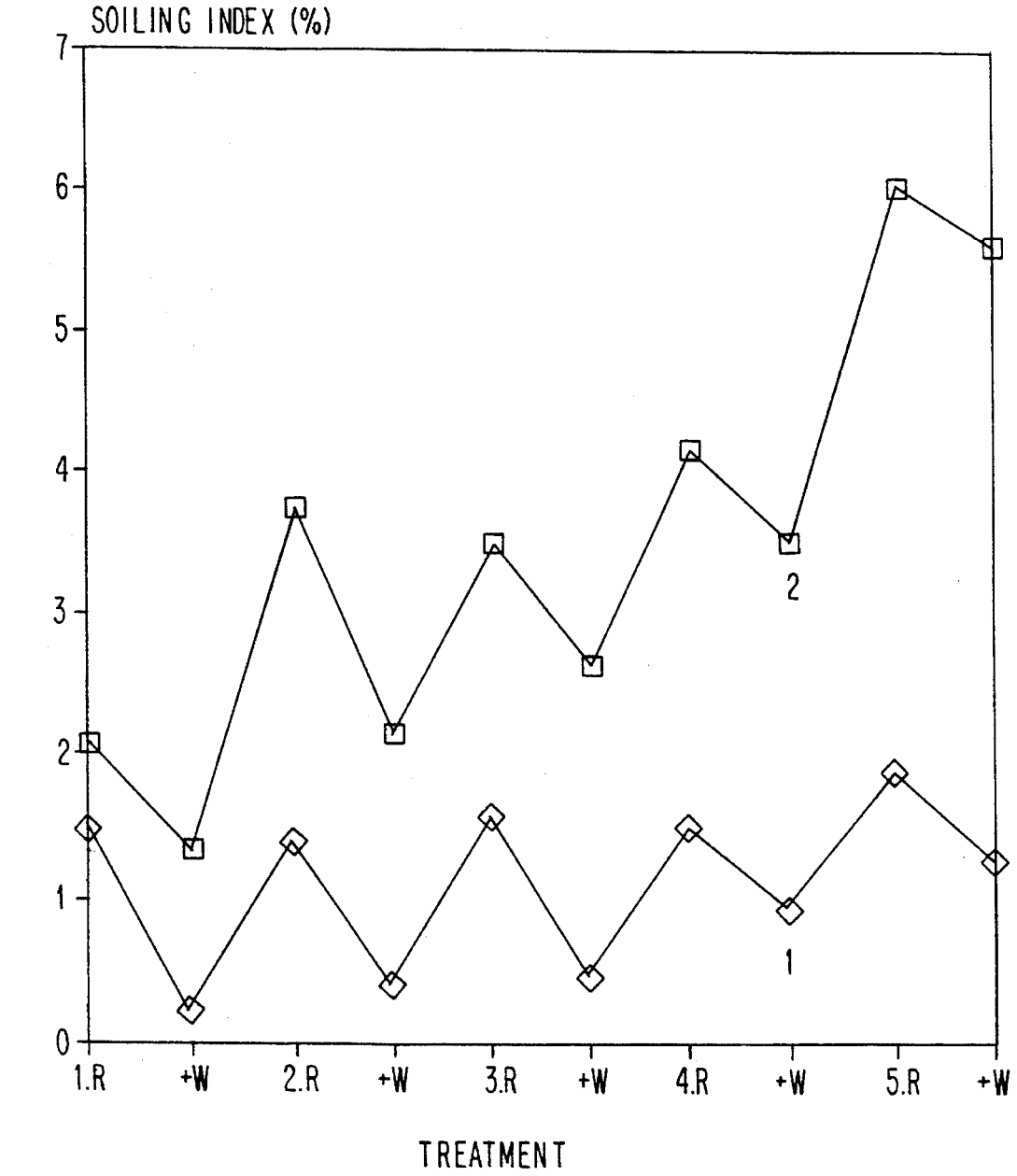
FIG. 1 is a view showing a diagram of soiling index of a soil-repellent monofilament in accordance with the present invention.

In accordance with the present invention a monofilament is proposed which contains 1.5 to 5% by weight of a polynary copolymer prepared from alkene and perfluoroalkines.

It is advantageous to use a polyester consisting of at least 85% by weight of polyethylene terephthalate. It may be pointed out as a particular advantage that the produced monofilament has a homogeneous composition over the entire cross-section. The melt may if necessary also have mixed into it from 1 to 3% of colour pigments.

A suitable polyethylene terephthalate has a viscosity index >96.

A suitable copolymer consists of about 50% by weight of ethene and about 50% by weight of tetrafluoroethene. The copolymer can be added to the melt in the form of a master batch consisting of about 50% by weight polyethylene terephthalate and about 50% by weight of copolymer.

Particularly suitable soil-repellent monofilaments are those having a diameter from 0.2 to 0.7 mm and consisting of a polyblend of polyethylene terephthalate having at least 85% by weight of polyethylene terephthalate units and from 1.5 to 5% by weight, in particular from 1.5 to 3.0% by weight, of a polynary copolymer prepared from alkenes and perfluoroalkenes.

Suitable polynary copolymers are in particular binary systems. These are simple to obtain by copolymerizing the individual components. Copolymers of ethene and tetrafluoroethene are advantageous on account of their ready availability, and a melting point within the range between 255° C. and 275° C. is particularly advantageous. Other binary or polynary fluoroplastics such as hexafluoropropylene-modified polytetrafluoroethylenes, polyvinylidene fluorides and the like can be used.

It is particularly advantageous for the monofilament to contain from 1.5 to 5% by weight of the copolymers with polyfluoroalkylene units, preferably from 1.5 to 3% by weight, in particular from 2 to 3% by weight.

The tenacity of the monofilaments is higher than 36 cN/tex, in particular from 36 to 60 cN/tex, coupled with an elongation of <44%, based on the unextended filament, and as the essential feature it is particularly surprising for the soil repellency to be so good. The soil repellency has been determined as a soiling index with <2 after 5 soiling/washing cycles, compared with >5 in the case of a polyester filament without copolymers.

The use of the novel soil-repellent monofilaments having a diameter from 0.2 to 0.7 mm is particularly suitable for producing paper machine wire-cloths.

The invention will now be more particularly described with reference to an operative example and a comparative example.

Comparative example without copolymers:

Hydrolysis-stabilized high-viscosity (VI 96) polyethylene terephthalate is melt-extruded in known manner at a temperature of 290° C. through a spinneret having an orifice diameter of 1.8 mm at a throughput of 86 g/min. The extruded monofilaments are cooled down in a waterbath at 70° C. After the cooling-off, the monofilaments are spin-finished, drawn to a draw ratio of in total 5.25×, relaxed and wound up at a speed of 100 m/min. The resulting thread, having a linear density of 2700 dtex, which corresponds to a diameter of 0.50 mm, has after a 5-fold treatment a soiling index of more than 5, has a tenacity (Ft) of 38 cN/tex coupled with an elongation (Dt) of 40% and a thermal shrinkage (TS at 160° C.) of 0.4%, based on the unshrunk thread.

Operative example:

To prepare the mixture (master batch), a compounder is used to process 50% by weight of polyethylene terephthalate (I) together with a copolymer (II) prepared from 50% by weight of ethylene and 50% by weight of tetrafluoroethylene.

High-viscosity (VI 96) polyethylene terephthalate (polyester) is melted at a temperature of 290° C. To the melt is added 4% by weight of the mixture (master batch), corresponding to 2% by weight of copolymer (II), by means of a metering device. Extrusion takes place via a spinneret having an orifice diameter of 1.8 mm, likewise at a throughput of 486 g/min. The extruded monofilaments are cooled down in the same way in a waterbath at 70° C. After the cooling-off, the monofilaments are spin-finished, drawn to a draw ratio of in total 5.25×, relaxed and wound up at a speed of 100 m/min. The resulting thread, having a diameter of 0.50 mm, has after a 5-fold treatment a soiling index of less than 2 (<2), has a tenacity (Ft) of 37 cN/tex coupled with an elongation (Dt) of 39% and a thermal shrinkage (TS at 160° C.) of 0.4%, based on the unshrunk thread.

To determine the soil-repellent effect of monofilaments for paper machine wire-cloths, the following method was developed:

Principle of test method:

Stainless steel platelets are precision-wound with three layers of the monofil. Following wash-off of the spin finish and colorimetric evaluation (DATACOLOR Texflash type 3881), the upper surface of the monofil card is soiled eight times in a defined way by "transfer printing" from a wet newspaper in a hot press at 130° C. Colorimetric evaluation is followed by specified washing, drying and colorimetric remeasurement. This soiling/washing process is carried out in total five times in succession to determine the soil-release properties at the same time. The result is quantified at each stage in terms of the DL* (D65) values, which are each based on the cards before the first soiling as reference. DL* (D65) corresponds to the lightness difference of the sample from the reference under daylight. To exclude influences due to the color differences of samples, the effect is reported as the percentage lightness decrease, which is defined as $$AI=[DL^*]/L^*_0\times 100$$

and is called the soiling index. $L^*_0$ is the lightness of the reference.

Soiling properties:

The AI values depicted in FIG. 1 show the influence of the successive cycles of "soiling" R/"washing"+W. Each point represents AI averages of two cards after soiling and after washing. Curve 1 shows the monofilament thread of the invention. Curve 2 shows a comparative thread of polyester according to the state of the art, i.e. without (II). After (five) 5 soiling/washing cycles the monofilament of the invention achieves indices below 2.

The monofil thread of the invention represents an improvement over the state of the art by a factor of from 4 to 5. It is preferably suitable for use in paper machine wire-cloths.

We claim:

1. Soil-repellent homogeneously structured monofilament for a paper machine wire-cloth said soil-repellent monofilament having a viscosity index of at least 96 dl/g and a homogeneous diameter from 0.2 to 0.7 mm and consisting at least 85% by weight of polyethylene terephthalate and from 1.5 to 5% by weight of a polynary copolymer prepared from at least one alkene and at least one perfluoroalkene.

2. Soil-repellent monofilament as defined in claim 1, having a tenacity of at least 36 cN/tex, an elongation of <44 % based on an unextended filament and a soiling index <2 after five soiling and washing cycles.

3. Process for making a soil-repellent monofilament for a paper machine wire-cloth comprising the steps of:

a) providing a polymer melt consisting of at least 85% by weight of polyethylene terephthalate having a viscosity index of at least 96 dl/g, and b) prior to extruding said soil-repellent monofilament, mixing from 1.5 to 5% by weight of a polynary copolymer prepared from at least one alkene and at least one perfluoroalkene;

c) and extruding, cooling, Spin-finishing, drawing, relaxing and winding up said monofilament.

* * * * *